US006824136B2

(12) United States Patent
Koopman

(10) Patent No.: US 6,824,136 B2
(45) Date of Patent: Nov. 30, 2004

(54) ALPHA CUBES GAME

(76) Inventor: Henry R. Koopman, 3400 S. Lowell Blvd. #12-104, Denver, CO (US) 80236

( * ) Notice: Subject to any disclaimer, the term of this patent is extended or adjusted under 35 U.S.C. 154(b) by 0 days.

(21) Appl. No.: 10/063,482

(22) Filed: Apr. 29, 2002

(65) Prior Publication Data

US 2003/0201601 A1 Oct. 30, 2003

(51) Int. Cl.[7] ..... A63F 9/04

(52) U.S. Cl. ..... 273/146; 273/272; 273/293; 273/299; 273/429; 273/431; 273/432

(58) Field of Search ..... 273/146, 432, 273/429, 431, 293, 299

(56) References Cited

U.S. PATENT DOCUMENTS

| | | | | | |
|---|---|---|---|---|---|
| 557,307 | A | * | 3/1896 | Foster | 434/172 |
| 830,514 | A | * | 9/1906 | Mansfield | 273/243 |
| 1,286,631 | A | * | 12/1918 | Hillyard | 434/170 |
| 1,412,204 | A | | 4/1922 | Derby | 434/172 |
| 1,481,628 | A | * | 1/1924 | Souza | 273/146 |
| 1,523,615 | A | * | 1/1925 | Stern | 273/146 |
| 1,524,529 | A | * | 1/1925 | Allen | 273/146 |
| 1,539,895 | A | * | 6/1925 | Buzza | 273/146 |
| 1,584,316 | A | * | 5/1926 | Meyhew | 273/146 |
| 1,684,609 | A | * | 9/1928 | Walker | 273/146 |
| 2,178,193 | A | * | 10/1939 | Wade | 273/143 A |
| 2,491,883 | A | * | 12/1949 | Welch | 434/167 |
| 3,670,427 | A | * | 6/1972 | Stolpen | 434/157 |
| 3,959,893 | A | * | 6/1976 | Sigg | 434/208 |
| 4,055,348 | A | | 10/1977 | Marzoni, Jr. | 273/146 |
| 4,735,419 | A | | 4/1988 | Koca | 273/292 |
| 4,892,319 | A | * | 1/1990 | Johnson, II | 273/272 |
| 4,934,700 | A | * | 6/1990 | Turek | 273/146 |
| 4,966,366 | A | * | 10/1990 | Mercado-Torres | 273/458 |
| 5,135,231 | A | * | 8/1992 | Piper | 273/254 |
| 5,364,101 | A | * | 11/1994 | Spooner et al. | 273/146 |
| 5,365,885 | A | * | 11/1994 | Baxter | 119/521 |
| 5,429,371 | A | * | 7/1995 | Bledsoe | 273/272 |
| 5,456,467 | A | * | 10/1995 | Hoover | 273/146 |
| 5,558,328 | A | * | 9/1996 | Krantz | 273/146 |
| 5,605,331 | A | * | 2/1997 | Boe | 273/146 |
| 5,639,094 | A | * | 6/1997 | Manchester | 273/432 |
| 5,702,105 | A | * | 12/1997 | Glikmann | 273/272 |
| 5,833,465 | A | | 11/1998 | Jarzewiak | 434/171 |
| 5,884,915 | A | * | 3/1999 | Koziol | 273/245 |
| D423,050 | S | | 4/2000 | Rink et al. | D19/59 |
| 6,508,469 | B2 | * | 1/2003 | Promutico | 273/274 |

FOREIGN PATENT DOCUMENTS

| | | |
|---|---|---|
| CA | 552193 | 1/1958 |
| CA | 553458 | 2/1958 |

* cited by examiner

*Primary Examiner*—Benjamin H. Layno
*Assistant Examiner*—Dolores R. Collins
(74) *Attorney, Agent, or Firm*—Roger A. Jackson

(57) ABSTRACT

A competitive points based English alphabet word construction game apparatus and method for players who create words from letters determined from a single chance element initiation per turn that is selected from a group of chance elements, wherein long words created from infrequently used letters are rewarded with enhanced points levels. Broadly, the game includes five chance elements comprising a first, a second, a third, a fourth, and a fifth chance elements that each includes six distinct perceptible areas. The first chance element includes six areas, each one a vowel, being A, E, I, O, U, and including the sometimes vowel Y. The second, third, fourth, and fifth chance elements each include six areas, for a total of twenty four areas, the twenty four areas each include a unique one of the twenty consonant letters of the English alphabet and four blank areas.

8 Claims, 5 Drawing Sheets

ALPHA CUBES GAME

TECHNICAL FIELD

The present invention is directed to a word game wherein words are created from letters derived from chance elements. More particularly, the present invention is a competitive points based English alphabet word construction game apparatus and method for players who create words from letters determined from a group of chance elements, wherein long words created from infrequently used letters are rewarded with enhanced points levels.

BACKGROUND OF INVENTION

It is well recognized in the prior art the benefit of playing word games as an enjoyable method by which an individual can build their vocabulary and spelling skills. Most word games have an element of chance and an element of competitive strategy that allows the player to win the game while utilizing a minimal amount of apparatus required to play the game. There are numerous approaches to playing word games, although most of the games utilize a series of chance elements, typically being dice that contain six sides, in that each of the sides normally has an indicia in the form of a letter. The dice are then rolled by the player with the top side of the dice counting as letters that the player can utilize in an attempt to create a word, wherein there are numerous rules for converting the created word into a points system that eventually will lead to a game winner. In addition, sometimes specialty cards are used in conjunction with the dice to enhance the word creation ability of the player.

Prior examples include U.S. Pat. No. 5,558,328 to Krantz that discloses a word game using twelve six sided dice, wherein a plurality of dice are rolled by the player who tries to make a word from the uppermost side of each die's letter. However, not all letters are on the dice and the highest frequency letters are used more than once on the dice, with the limitation that no one die has the same letter twice. Also, a die side can have more than one letter present to aid in making words, using one of the two letters on the side. Joker or blank dice sides are used for any letter to be used or selected by the player. The player must make a word from a singular role of dice, with points awarded based upon the size of the word, in other words more letters equate to more points. Another prior art example would be U.S. Pat. No. 1,412,204 to Derby that discloses a word game that uses six sets of differently colored cubes with each cube having six sides with each side having one letter so that each cube spells a six letter word and a set of six cubes also spells the same word, but without using the same letter twice. In other words, each cube of a set is identical. The cube sets spell different words. To play, a player uses one set of cubes and rolls them and scores points based on the portion of the length of the word spelled correctly. The player must make a word from a singular dice roll, with points awarded based upon the partial correct spelling of the word, with more letters equaling more points awarded. If a first letter of the word appears three times in any throw, that player loses their entire score to that point, if six of the same letters are thrown, the player's score is doubled. As yet another prior art example is Canadian Patent No. 552,193 to Barber that discloses a word game using a set of five dice, wherein one side of each die has one different vowel with the dice set having twenty one of the consonants and four joker sides total, such that one cube has no joker. Alternatively, the dice can be arranged to have all the five vowels on one cube with one joker side and to use the twenty one consonants on the remaining four cubes with three jokers, such that one cube has no joker. To play, the player's roll of the set of five dice tries to make a word from the uppermost sides of the dice. Barber has no specifics for scoring rules, only that a form could be used to complete a crossword puzzle type of form and suggests that the players make up their own rules for scoring.

Other prior art word games would include U.S. Pat. No. 4,966,366 to Mercado-Torres that discloses a word game that uses a set of ten cubes that are each marked with different letters on the six sides of each cube and a set of word cards that do not have a word longer than ten letters and with the words on the word cards being able to be made from the various cube combinations. The most frequently used letters appear twice on the cubes and the letters having a lesser frequency of use appear only once on the cubes. The game is played by picking a card and then arranging the cubes to spell the word in the least amount of time. A simpler prior game is disclosed in U.S. Pat. No. 4,934,700 to Turek that discloses a word game that uses twenty four identical six sided dice, with each side of the die marked with the unique letter of the six letter target word so that the die contains all the letters of the target word. The game is played by each player being given six dice, and the player then rolls one die in an attempt to have the first letter H of the target word shown in this example as the word HEARTS that would land face up on the die, and then the player attempts to roll the second letter E with the first player who spells the entire target word being the winner. When the player rolls the desired letter, that particular die joins that player's completion set, and at that player's next turn they roll one of their remaining dies. When a player successfully rolls the desired letter of the target word that player continues to get additional turns until they roll an undesirable letter. A final prior art example would be Canadian patent No. 553,458 to Holloway that discloses a word game that includes fifteen dice with thirteen of the dice having letters, with one die being blanked, and with one die being a conventional die with dots one through six on its six sides. The blank die is a wild die that can be used for any desired letter and the conventional dotted die is used to multiply that player's score. The distribution of the letters on the thirteen dice are arranged in their frequency of occurrence of use. The game is played by throwing the dice and a player than arranging the dice to form words in order to maximize their score. As is typical, longer words equate to higher scores with score additions from the wild die available. Challenges are also allowed with points gained or lost for successful or unsuccessful challenges respectively by rearranging the other player's dice for higher points words.

What has not been disclosed is a word construction game that allows a higher proportion of player strategy as opposed to the prior art concentrating mostly on player chance by typically initiating a chance element or more specifically rolling a set of dice to determine the letters available for spelling a word. Most of the prior games disclosed limit the size and type of word that can be created and do not allow it to be "built" out of multiple turns that the player can take, thus allowing the player to either use letters gained from a chance element or to store those letters in a bank for later use, wherein the player would receive enhanced awards for both the creation of a longer word and a word that uses less frequently used consonant letters. For a word game to truly stimulate creative thinking there should be absolutely no limit on the length of the words created. Also, there should be a strategic component in the players selecting which single one of the chance elements to initiate or roll on their turn, this allows the player some discretion in using their banked letters in conjunction with the letters that the player desired. What is needed is a word construction game that has a higher proportion of player strategy in relation to player chance in the ability to win the game while the same time keeping the game apparatus very simple.

SUMMARY OF INVENTION

It is an object of the present invention to provide a new and useful competitive points based English alphabet word construction game apparatus and method hereby termed the Alpha Cubes Game, that combines the elements of chance and knowledge into winning the game, wherein there are no player age limits, there are no limits on the number of players, and there are no limits as to what type of words may be created as long as the words are verifiable in a dictionary.

It is another object of the present invention to provide for enhanced points levels awards for the players, when the players create words and that are long in letter length and that utilize infrequently used letters in English language.

It is a further object of the present invention to allow players to bank letters that are indicated from the initiation of the chance elements to add an element of strategy for the player to engage in for the type of word that is created by the player.

Still another object of the present invention is to provide for a points liability for the player based upon the size of the letter bank and the type of letters in the letter bank that the player holds at each turn.

Still yet another object of the present invention is to provide for points liability for the player who creates words that are not dictionary verifiable and a corresponding bonus to the player who successfully challenges another player's word creation validity.

It is further yet another object of the present invention to provide for a chance element having a non letter indication that once initiated by the player allows the player to select any one of the indicia available on that particular chance element to use in the creation of a word.

It is yet another object of the present invention to provide for a player's net score to be calculated at the player's turn determined from points gained from properly created words minus points liabilities based upon the player's letter bank and improperly created words, with that players score compared to a selected predetermined score to ascertain whether that player has a sufficient amount of net points to win that particular game.

The present invention is a competitive points based English alphabet word construction game apparatus and method for players who create words from letters determined from a single chance element initiation per turn that is selected from a group of chance elements, wherein long words created from infrequently used letters are rewarded with enhanced points levels. Broadly the present invention includes, five chance elements comprising, a first, a second, a third, a fourth, and a fifth chance element, each of the chance elements includes six areas having a distinct perceptible indication for a total of thirty areas. More specifically, the first chance element includes six indicia bearing areas, each of the first chance element indicia bearing areas representing one of the five English alphabet vowels, being A, E, I, O, U, and including the sometimes vowel Y for the six indicia on the first chance element. Also included are, the second, third, fourth, and fifth chance elements that each also include the six indicia bearing areas, resulting in a total of twenty-four areas, for the second, third, fourth, and fifth chance elements. These twenty-four areas each include an indicia representing one of the twenty consonant letters of the English alphabet and four non-indicia areas.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
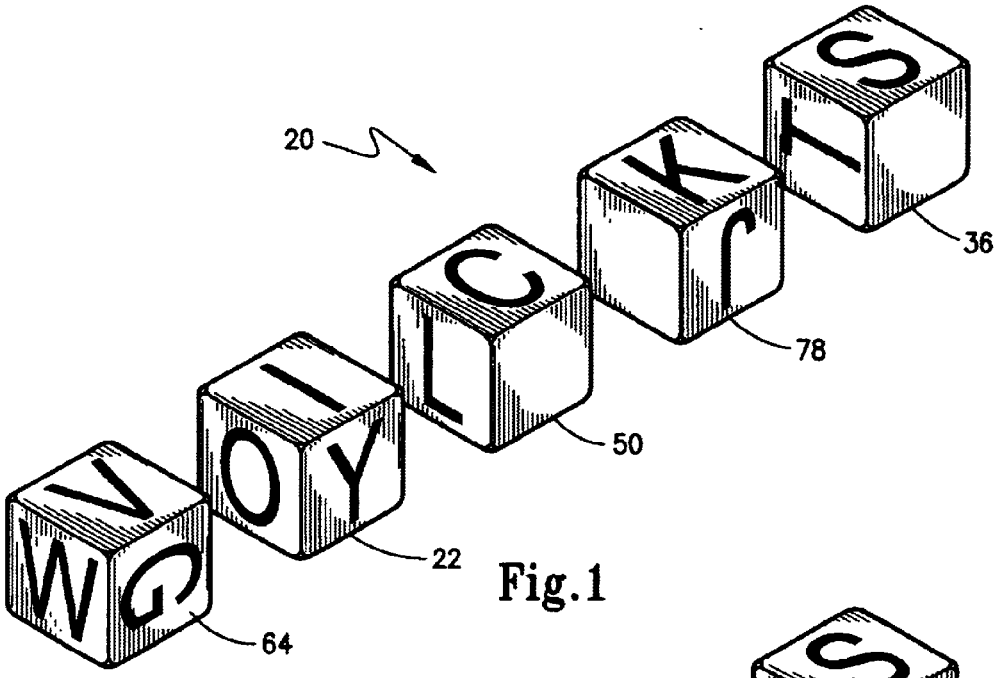
FIG. 1 shows a perspective view of an exemplary embodiment of the present invention showing the five dice aligned such that the word VICKS is spelled on the face up sides of the dice with all the letters appearing on the dice in accordance with the present invention.

20 Alpha Cubes Game assembly
22 First chance element or blue vowels letter cube
24 Vowels cube letter A side
26 Vowels cube letter E side
28 Vowels cube letter Y side
30 Vowels cube letter U side
32 Vowels cube letter O side
34 Vowels cube letter I side
36 Second chance element or red first highest frequency of letter use consonant cube
38 Red consonant cube blank non-letter side
40 Red consonant cube letter N side
42 Red consonant cube letter H side
44 Red consonant cube letter T side
46 Red consonant cube letter S side
48 Red consonant cube letter R side
50 Third chance element or green second highest frequency of letter use consonant cube
52 Green consonant cube blank non-letter side
54 Green consonant cube letter L side
56 Green consonant cube letter M side
58 Green consonant cube letter D side
60 Green consonant cube letter F side
62 Green consonant cube letter C side
64 Fourth chance element or yellow third highest frequency of letter use consonant cube
66 Yellow consonant cube blank non-letter side
68 Yellow consonant cube letter P side
70 Yellow consonant cube letter V side
72 Yellow consonant cube letter W side
74 Yellow consonant cube letter G side
76 Yellow consonant cube letter B side
78 Fifth chance element or orange fourth highest frequency of letter use consonant cube

80 Orange consonant cube blank non-letter side
82 Orange consonant cube letter X side
84 Orange consonant cube letter Z side
86 Orange consonant cube letter K side
88 Orange consonant cube letter J side
90 Orange consonant cube letter Q side
92 Letter tiles assembly
93 Non letter tiles assembly
94 Letter tile
96 Blue tile
98 Red tile
100 Green tile
102 Yellow tile
104 Orange tile
200 Basic Alpha Cubes Game method
202 Initial step of players rolling the blue vowel cube
204 Decision step of which player rolled the letter closest to the beginning of the alphabet
206 Step of another player rolling a cube first
208 Decision step of first rolling player selecting cube color to roll
210 Step of first player rolling selected cube
212 Decision step of first player roll result being a letter side or a blank side
214 Step of first player selecting any rolled cube letter or blank to select a letter later to use if blank side is rolled
216 Decision step of first player banking a blank or having the option of banking or using the rolled letter, or the selected letter in order to create a word
218 Step if rolled, or selected letter, or blank is banked, the banked letter or blank is recorded on the first player's letter or color tile respectively
220 Step of first player creating word with banked, rolled, and selected letters
222 Step of dictionary validation of first player created word
224 Step of deducting first player points if dictionary validation fails
226 Step of adding first player points if dictionary validation succeeds
228 Decision step of checking the first player's calculated net score against a selected predetermined winning score
230 Step of repeating the Basic Alpha Cubes Game method above for the second player and subsequent players including returning to the first player for a second turn and continuing the game until a winner is determined
232 Step of ending game if first player's calculated net score is equal to or above a selected predetermined winning score
234 Continuation of step 210 to step 212
236 Continuation of step 226 to step 228
238 Continuation of step 218 to step 230

DETAILED DESCRIPTION

The present invention is a competitive points based English alphabet word construction game apparatus and method for players who create words from letters determined from a single chance element initiation per turn that is selected from a group of chance elements, wherein long words created from infrequently used letters are rewarded with enhanced points levels. Broadly the present invention includes, five chance elements comprising a first, a second, a third, a fourth, and a fifth chance element, each of the chance elements includes six areas having a distinct perceptible indication for a total of thirty areas. More specifically, the first chance element includes six indicia bearing areas, each of the first chance element indicia bearing areas representing one of the five English alphabet vowels, being A, E, I, O, U, and including the sometimes vowel Y for the six indicia on the first chance element. Also included are, the second, third, fourth, and fifth chance elements that each also include the six indicia bearing areas, resulting in a total of twenty-four areas, for the second, third, fourth, and fifth chance elements. These twenty-four areas each include an indicia representing one of the twenty consonant letters of the English alphabet and four non-indicia areas.

Figure 4:
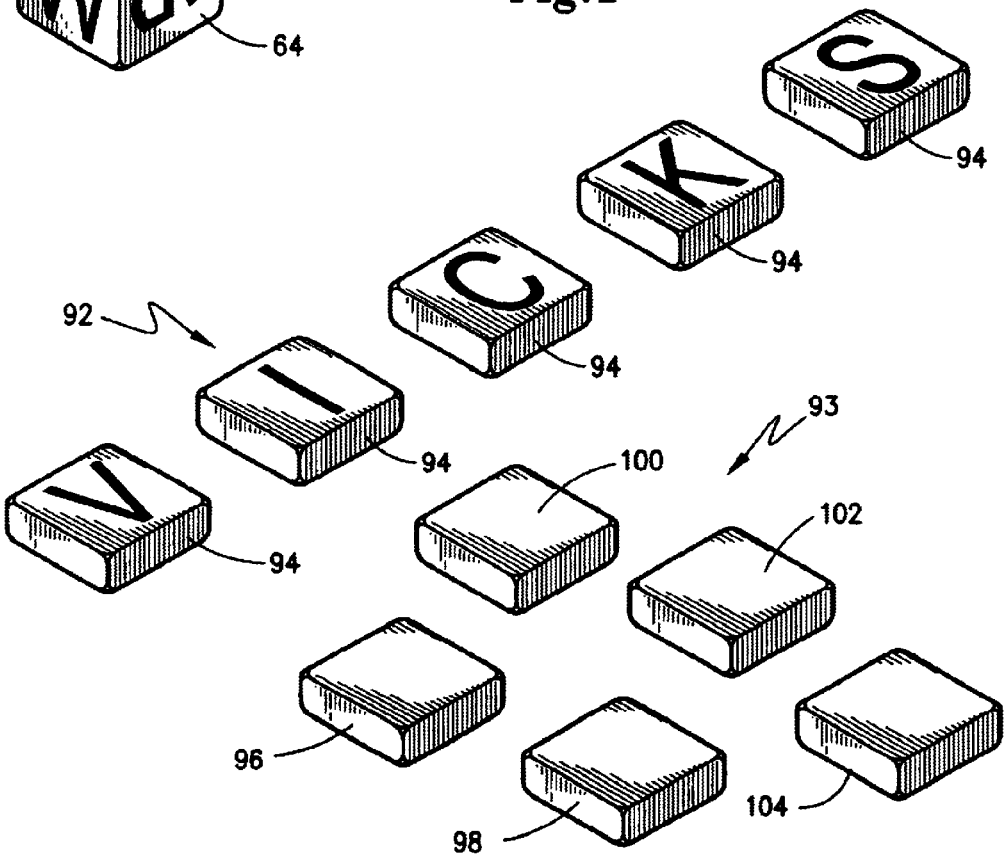
FIG. 4 shows a perspective view of an exemplary embodiment of the present invention showing the letter tiles that are used to record a player's letters stored in their letter bank, what is shown is specifically in accord with the word VICKS as depicted in FIG. 1, also shown are the non lettered color tiles that can also be stored in a player's bank.
Figure 2:
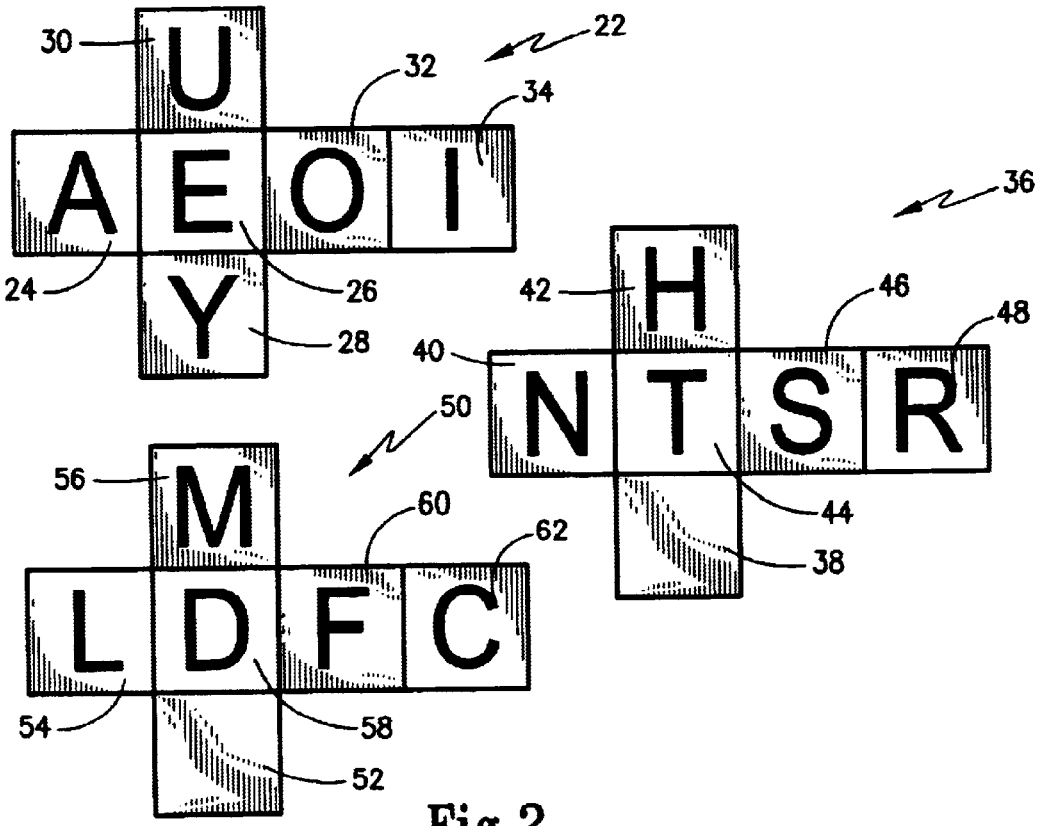
FIG. 2 shows a flat pattern layout or a planar representation of the letters on each of the sides of a vowel cube, the representation of the letters and blank on each of the sides of a first highest frequency consonant cube, and the representation of the letters and blank on each of the sides of a second highest frequency consonant cube respectively.
Figure 3:
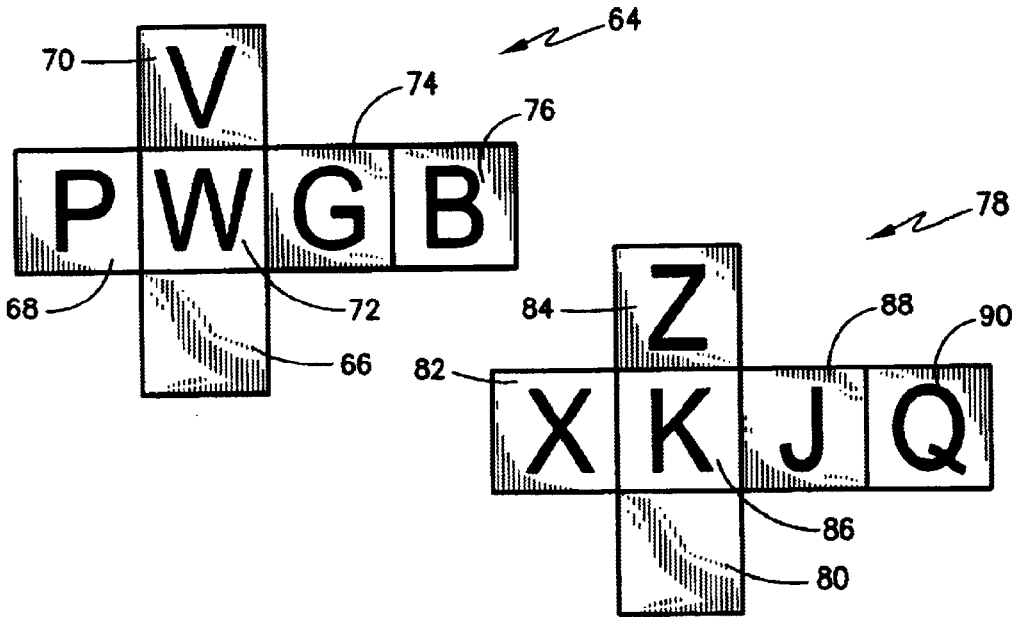
FIG. 3 shows a flat pattern layout or a planar representation of the representation of the letters and blank on each of the sides of a third highest frequency consonant cube, and the representation of the letters and blank on each of the sides of a fourth highest frequency consonant cube respectively.
Figure 5:
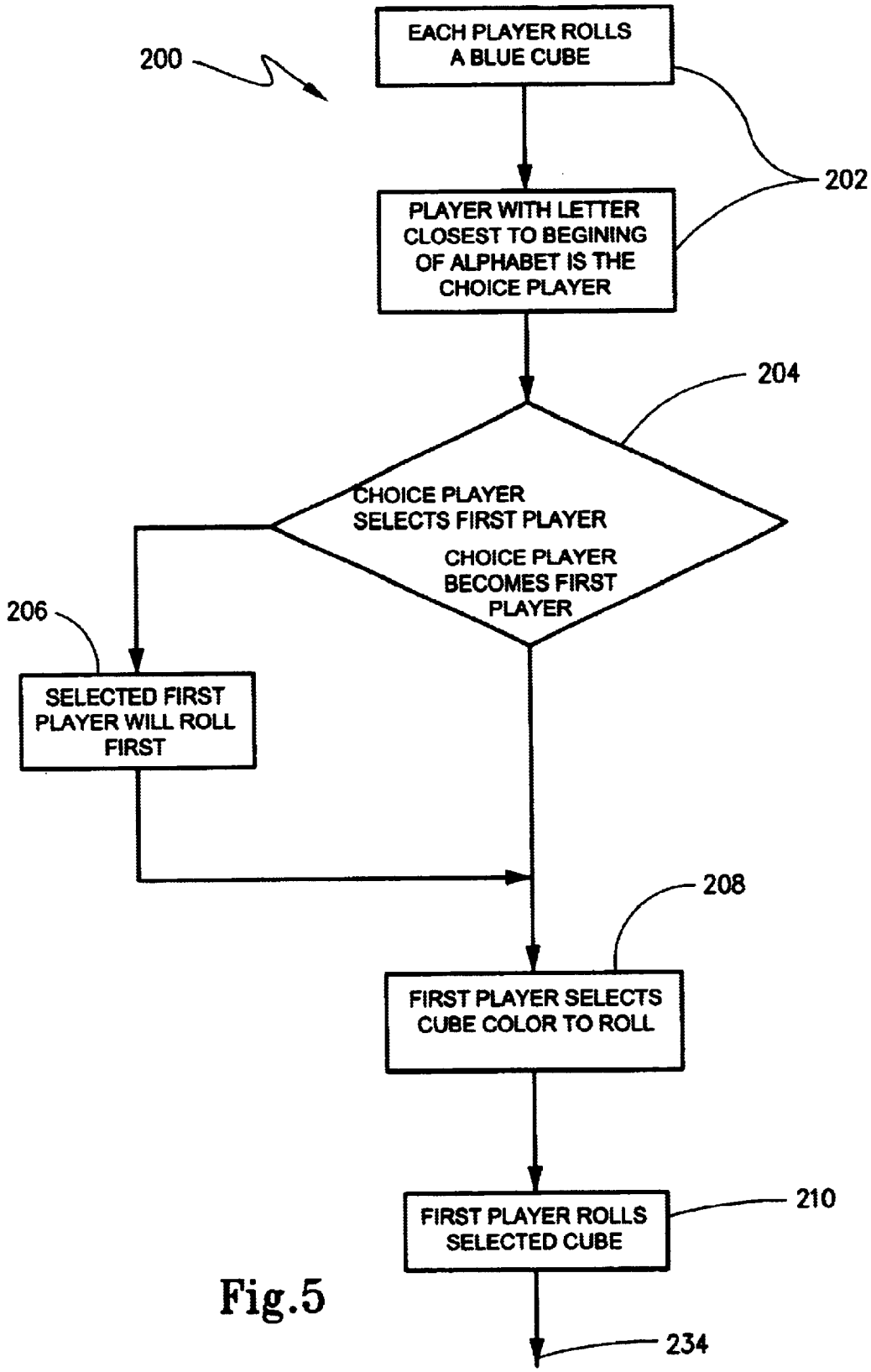
FIG. 5 is a functional summary block diagram of an exemplary embodiment of the present invention illustrating the basic method of playing the Alpha Cubes Game.

With initial reference to FIGS. 1 through 4 the apparatus portion of the present invention is disclosed, wherein FIG. 5 discloses the method of playing the present invention. Starting with FIG. 1 shown is a perspective view of an exemplary embodiment of the present invention 20 showing the five dice aligned such that the word VICKS is spelled on the face up sides of the dice with all the letters appearing on the dice in accordance with the present invention 20. The present invention 20 has been termed the "Alpha Cubes Game" and basically includes five different chance elements. The differences between these five chance elements are related to the distinct perceptible indications or indicia that exist on each area of the chance element. Shown in the exemplary embodiment of the present invention 20 the chance elements, which are conventional six sided cubes or dice, resulting in each chance element having six faces, sides, or areas that can have a unique indicia on each face. Also, in the exemplary embodiment of the present invention 20 the five chance elements are differentiated by each chance element being a unique color being described as follows. Looking specifically to FIGS. 1 through 3, with FIG. 1 showing a perspective on an exemplary embodiment of the present invention 20 as previously described, FIG. 2 shows a flat pattern layout or a planar representation of the letters or indicia on each of the sides or areas of the first chance element 22 or vowel cube 22, also the representation of the letters and blank on each of the sides or areas of the second chance element 36 or the first highest frequency consonant cube 36, and the representation of the letters or indicia and blank on each of the sides or areas of the third chance element 50 or the second highest frequency consonant cube 50 respectively. Also, FIG. 3 shows a flat pattern layout or a planar representation of the representation of the letters or indicia and blank on each of the sides or areas of the fourth chance element 64 or the third highest frequency consonant cube 64, and the representation of the letters or indicia and blank on each of the sides or areas of the fifth chance element 78 or the fourth highest frequency consonant cube 78 respectively.

Specifically looking at FIGS. 1 and 2, the first chance element 22 which is termed the blue vowels cube or die 22 is shown in a flat pattern layout such that the six areas contain the five vowels of the English alphabet being; A, E, I, O, and U with the sometimes vowel Y being included for a total of six different indicia or letters to occupy the six areas of the first chance element 22. It should be mentioned at this point that the two methods by which to enhance the player's score in the present invention is to either create long words by the use of a large number of letters by the player and/or to use letters that have an infrequent occurrence of use in the English language, thus this is what forms the basis for the arrangement of the indicia or letters on the five chance elements or cubes of the present invention 20. The vowels A, E, I, and O are in the top six letters of the English alphabet for frequency of use. The other two letters being U and Y occur at a lower frequency in the English Language, however, the odds are that when the blue or vowel cube 22 is rolled, at least to a probability of approximately 67% that a high frequency letter specifically being A, E, I, or O will be available to the player as coming face up on the blue cube 22. Thus, rolling the blue cube 22 will normally result in a highly useable letter being available to the player, however, with the letters on the blue cube 22 being worth minimal points to the player because they are easier to place in a created word. The first chance element 22 or blue vowel cube 22 has the vowel A on side 24, the vowel E on side 26, the vowel I on side 34, the vowel O on side 32, and the vowel U on side 30. Also the sometimes vowel Y is on side 28. Although the first chance element 22 or blue vowel cube 22 is depicted as a six sided or six area cube in the preferred embodiment of the present invention 20, the first chance element 22 could assume a number of different configurations alternative to being a six sided cube as shown. Any type of a chance element would be acceptable that has distinctively perceptible indication areas that could be used for the aforementioned indicia or letters for the first chance element 22. Thus, the first chance element 22 could be a round ball such as a lottery ball that has six distinctively perceptible indication areas. What is important is that the first chance element 22 when initiated by the player, allows any one of the six distinctively perceptible indication areas to be randomly indicated on an equal chance basis to be used by the player who would initiate the first chance element 22 individually or alone on a selected basis by the player, meaning that the player has the ability to select any one chance element they desire to initiate or roll. In the case of the chance element being a cube that the player rolled, the player will acquire one of the chance element letters to use in the creation of a word normally by using the uppermost face of the cube after it is rolled. Thus, the odds of the player being able to use either A, E, I, O, U, or Y from the players initiating the first chance element 22 would be one in six. Preferably, the present invention 20 uses for manufacturing and cost convenience a plastic six-sided cube as the first chance element 22. Also, in addition to the first chance element 22 not having to be a plastic six-sided cube, the materials of construction of the first chance element 22 could be steel, wood, or any other material that would meet the aforementioned requirements. Additionally, the six perceptible indications or indicia on the first chance element 22 can be printed, etched, stenciled, or made perceptible in any other manner that again would meet the aforementioned requirements.

Again, specifically looking at FIGS. 1 and 2, the second chance element 36 which is termed the red consonant cube or die 36 is shown in a flat pattern layout such that the six areas each contain the following of, a unique one of the five highest use consonants of the English alphabet being; N, T, H, S, and R with one blank or non indicia area being included to occupy the six areas of the second chance element 36. It should be mentioned at this point that the two methods by which to enhance the player's score in the present invention is to either create long words by the use of a large number of letters by the player and/or to use letters that have an infrequent occurrence of use in the English language, thus this is what forms the basis for the arrangement of the indicia or letters on the five chance elements or cubes of the present invention 20. The consonants N, T, H, S, and R are the top five consonant letters of the English alphabet for frequency of use. Thus, rolling the red cube 36 will normally result in a highly useable letter being available to the player, however, with the letters on the red cube 36 being worth minimal points to the player because they are easier to place in a created word. The second chance element 36 or red consonant cube 36 has the consonant N on side 40, the consonant T on side 44, the consonant H on side 42, the consonant S on side 46, and the consonant R on side 48. Also the non-indicia or blank area is on side 38. Although the second chance element 36 or red consonant cube 36 is depicted as a six sided or six area cube in the preferred embodiment of the present invention 20, the second chance element 36 could assume a number of different configurations alternative to being a six sided cube as shown. Any type of a chance element would be acceptable that has distinctively perceptible indication areas that could be used for the aforementioned indicia or letters and blank side for the second chance element 36. Thus, the second chance element 36 could be a round ball such as a lottery ball that has six distinctively perceptible indication areas. What is important is that the second chance element 36 when initiated by the player, allows any one of the six distinctively perceptible indication areas to be randomly indicated on an equal chance basis to be used by the player who would initiate the second chance element 36 individually or alone on a selected basis by the player, meaning that the player has the ability to select any one chance element they desire to initiate or roll. In the case of the chance element being a cube that the player rolled, the player will acquire one of the chance element letters or the blank side that allows the player to select any letter from the cube, in either case for the player to use the rolled letter or the selected letter in the creation of a word normally by using the uppermost face of the cube after it is rolled. Thus, the odds of the player being able to use either N, T, H, S, T, or the blank side or area from the players initiating the second chance element 36 would be one in six. Preferably, the present invention 20 uses for manufacturing and cost convenience a plastic six-sided cube as the second chance element 36. Also, in addition to the second chance element 36 not having to be a plastic six-sided cube, the materials of construction of the second chance element 36 could be steel, wood, or any other material that would meet the aforementioned requirements. Additionally, the six perceptible indications or indicia and blank area on the second chance element 36 can be printed, etched, stenciled, or made perceptible in any other manner that again would meet the aforementioned requirements.

Moving next to also looking at FIGS. 1 and 2, the third chance element 50 which is termed the green consonant cube or die 50 is shown in a flat pattern layout such that the six areas each contain the following of, a unique one of the five second highest use consonants of the English alphabet being; L, D, M, F, and C with one blank or non indicia area being included to occupy the six areas of the third chance element 50. It should be mentioned at this point that the two methods by which to enhance the player's score in the present invention is to either create long words by the use of a large number of letters by the player and/or to use letters that have an infrequent occurrence of use in the English language, thus this is what forms the basis for the arrangement of the indicia or letters on the five chance elements or cubes of the present invention 20. The consonants L, D, M, F, and C are the second highest five consonant letters of use for the English alphabet. Thus, rolling the green cube 50 will normally result in a moderately useable letter being available to the player, and accordingly, with the letters on the green cube 50 being worth a moderate amount of points to the player because they have an average usability to place in a created word. The third chance element 50 or green consonant cube 50 has the consonant L on side 54, the consonant D on side 58, the consonant M on side 56, the consonant F on side 60, and the consonant C on side 62. Also the non-indicia or blank area is on side 52. Although the third chance element 50 or green consonant cube 50 is depicted as a six sided or six area cube in the preferred embodiment of the present invention 20, the third chance element 50 could assume a number of different configurations alternative to being a six sided cube as shown. Any type of a chance element would be acceptable that has distinctively perceptible indication areas that could be used for the aforementioned indicia or letters and blank side for the third chance element 50. Thus, the third chance element 50 could be a round ball such as a lottery ball that has six distinctively perceptible indication areas. What is important is that the third chance element 50 when initiated by the player, allows any one of the six distinctively perceptible indication areas to be randomly indicated on an equal chance basis to be used by the player who would initiate the third chance element 50 individually or alone on a selected basis by the player, meaning that the player has the ability to select any one chance element they desire to initiate or roll. In the case of the chance element being a cube that the player rolled, the player will acquire one of the chance element letters or the blank side that allows the player to select any letter from the cube, in either case for the player to use the rolled letter or the selected letter in the creation of a word normally by using the uppermost face of the cube after it is rolled. Thus, the odds of the player being able to use either L, D, M, F, C, or the blank side or area from the players initiating the third chance element 50 would be one in six. Preferably, the present invention 20 uses for manufacturing and cost convenience a plastic six-sided cube as the third chance element 50. Also, in addition to the third chance element 50 not having to be a plastic six-sided cube, the materials of construction of the third chance element 50 could be steel, wood, or any other material that would meet the aforementioned requirements. Additionally, the six perceptible indications or indicia and blank area on the third chance element 50 can be printed, etched, stenciled, or made perceptible in any other manner that again would meet the aforementioned requirements.

Further looking to FIGS. 1 and 3, the fourth chance element 64 which is termed the yellow consonant cube or die 64 is shown in a flat pattern layout such that the six areas each contain the following of, a unique one of the five third highest use consonants of the English alphabet being; P, W, V, G, and B with one blank or non indicia area being included to occupy the six areas of the fourth chance element 64. It should be mentioned at this point that the two methods by which to enhance the player's score in the present invention is to either create long words by the use of a large number of letters by the player and/or to use letters that have an infrequent occurrence of use in the English language, thus this is what forms the basis for the arrangement of the indicia or letters on the five chance elements or cubes of the present invention 20. The consonants P, W, V, G, and B are the third highest five consonant letters of use for the English alphabet. Thus, rolling the yellow cube 64 will normally result in a somewhat useable letter being available to the player, and accordingly, with the letters on the yellow cube 64 being worth a higher amount of points to the player because they have an lower usability to place in a created word. The fourth chance element 64 or yellow consonant cube 64 has the consonant P on side 68, the consonant W on side 72, the consonant V on side 70, the consonant G on side 74, and the consonant B on side 76. Also the non-indicia or blank area is on side 66. Although the fourth chance element 64 or yellow consonant cube 64 is depicted as a six sided or six area cube in the preferred embodiment of the present invention 20, the fourth chance element 64 could assume a number of different configurations alternative to being a six sided cube as shown. Any type of a chance element would be acceptable that has distinctively perceptible indication areas that could be used for the aforementioned indicia or letters and blank side for the fourth chance element 64. Thus, the fourth chance element 64 could be a round ball such as a lottery ball that has six distinctively perceptible indication areas. What is important is that the fourth chance element 64 when initiated by the player, allows any one of the six distinctively perceptible indication areas to be randomly indicated on an equal chance basis to be used by the player who would initiate the fourth chance element 64 individually or alone on a selected basis by the player, meaning that the player has the ability to select any one chance element they desire to initiate or roll. In the case of the chance element being a cube that the player rolled, the player will acquire one of the chance element letters or the blank side that allows the player to select any letter from the cube, in either case for the player to use the rolled letter or the selected letter in the creation of a word normally by using the uppermost face of the cube after it is rolled. Thus, the odds of the player being able to use either P, W, V, G, B, or the blank side or area from the players initiating the fourth chance element 64 would be one in six. Preferably, the present invention 20 uses for manufacturing and cost convenience a plastic six-sided cube as the fourth chance element 64. Also, in addition to the fourth chance element 64 not having to be a plastic six-sided cube, the materials of construction of the fourth chance element 64 could be steel, wood, or any other material that would meet the aforementioned requirements. Additionally, the six perceptible indications or indicia and blank area on the fourth chance element 64 can be printed, etched, stenciled, or made perceptible in any other manner that again would meet the aforementioned requirements.

Next further looking to FIGS. 1 and 3, the fifth chance element 78 which is termed the orange consonant cube or die 78 is shown in a flat pattern layout such that the six areas each contain the following of, a unique one of the five fourth highest use consonants of the English alphabet being; X, K, Z, J, and Q with one blank or non indicia area being included to occupy the six areas of the fifth chance element 78. It should be mentioned at this point that the two methods by which to enhance the player's score in the present invention is to either create long words by the use of a large number of letters by the player and/or to use letters that have an infrequent occurrence of use in the English language, thus this is what forms the basis for the arrangement of the indicia or letters on the five chance elements or cubes of the present invention 20. The consonants X, K, Z, J, and Q are the fourth highest five consonant letters of use for the English alphabet. Thus, rolling the orange cube 78 will normally result in a barely useable letter being available to the player, and accordingly, with the letters on the orange cube 78 being worth the highest amount of points to the player because they have an lowest usability to place in a created word. The fifth chance element 78 or orange consonant cube 78 has the consonant X on side 82, the consonant K on side 86, the consonant Z on side 84, the consonant J on side 88, and the consonant Q on side 90. Also the non-indicia or blank area is on side 80. Although the fifth chance element 78 or orange consonant cube 78 is depicted as a six sided or six area cube in the preferred embodiment of the present invention 20, the fifth chance element 78 could assume a number of different configurations alternative to being a six sided cube as shown. Any type of a chance element would be acceptable that has distinctively perceptible indication areas that could be used for the aforementioned indicia or letters and blank side for the fifth chance element 78. Thus, the fifth chance element 78 could be a round ball such as a lottery ball that has six distinctively perceptible indication areas. What is important is that the fifth chance element 78 when initiated by the player, allows any one of the six distinctively perceptible indication areas to be randomly indicated on an equal chance basis to be used by the player who would initiate the fifth chance element 78 individually or alone on a selected basis by the player, meaning that the player has the ability to select any one chance element they desire to initiate or roll. In the case of the chance element being a cube that the player rolled, the player will acquire one of the chance element letters or the blank side that allows the player to select any letter from the cube, in either case for the player to use the rolled letter or the selected letter in the creation of a word normally by using the uppermost face of the cube after it is rolled. Thus, the odds of the player being able to use either X, K, Z, J, Q, or the blank side or area from the players initiating the fifth chance element 78 would be one in six. Preferably, the present invention 20 uses for manufacturing and cost convenience a plastic six-sided cube as the fifth chance element 78. Also, in addition to the fifth chance element 78 not having to be a plastic six-sided cube, the materials of construction of the fifth chance element 78 could be steel, wood, or any other material that would meet the aforementioned requirements. Additionally, the six perceptible indications or indicia and blank area on the fifth chance element 78 can be printed, etched, stenciled, or made perceptible in any other manner that again would meet the aforementioned requirements.

Yet further looking to FIG. 4 shown is a perspective view of an exemplary embodiment of the present invention showing the letter tiles 92 that are used to record a player's letters stored in their letter bank, what is shown is specifically in accord with the word VICKS as depicted in FIG. 1, also shown are the non lettered color tiles 93 that can also be stored in a player's bank. Keeping in mind that the letter tiles 92 and non letter tiles 93 are optional for the playing of the present invention game as the tiles" function is as a record keeping device for each player based upon a player's decision to either bank the letter from their turn or to use the letter in the creation of a word. The letter tiles 94 are specifically or preferably parallelopiped in shape with one of the larger sides or areas having an indicia that matches the indicia that is on the first, second, third, fourth, and fifth chance elements. For player convenience the letter tiles are provided in pluralities for each indicia thus allowing each player to have multiples of each indicia available for their letter bank. Also provided are the non letter tiles 93 which are used for the player to bank the perceptible indication of a blank side or area coming topside, thus being available to the player to either use in the creation of a word which allows the player to choose any indicia from that particular cube or to bank the ability to choose any indicia from that particular cube or in the case of the first chance element 22 known as the blue vowel cube 22 arbitrarily making one of the indicia a wild or joker to allow a player to substitute in a created word or bank any chosen indicia from the blue vowels cube 22. Thus, it is required that the non letter tiles 93 be of a specific matching color to the first, second, third, fourth, or fifth chance elements, this results in a blue non letter tile 96, a red non letter tile 98, a green non letter tile 100, a yellow non letter tile 102, and an orange non letter tile 104. As with the letter tiles 92 the non-letter tiles 93 are provided in a plurality to allow a player to bank multiples of specific color non-letter tiles 92 for later use in creating words. It is preferred that the letter tiles 92 and the non letter tiles 93 be provided in a quantity of approximately 250 tiles with the standard game 20 set of five chance elements. Of course, more or less tiles could be provided with the game 20 depending upon the number of players and their ability levels.

Due to the purpose of the letter tiles 92 and the non letter tiles 93 the specific type of construction of the tiles is not important, although preferably the letter tiles 92 and the non letter tiles 93 are parallelopiped in shape and constructed of plastic. However, any number of alternatives would be acceptable both for configuration and material of construction as the function of the tiles is for keeping a record only as long as a perceptible record is achievable. Thus, any configuration outside of a parallelopiped would be acceptable; as well as other materials of construction would be acceptable. In addition, the indicia on the letter tiles 92 and blank area on the non-letter tiles 93 can be printed, etched, stenciled, or made perceptible in any other manner that again would meet the aforementioned requirements.

Note that the first chance element 22, second chance element 36, third chance element 50, fourth chance element 64, and fifth chance element 78 are previously identified as each being in a unique color for ease in playing the game for points scoring purposes along with the matching unique color non letter tiles 93. However, this is a matter of scoring convenience only, with the particular colors used not being mandatory with any other color scheme being acceptable or other means of making an easy perceptible differentiation to the players of the five chance elements 20 and matching non letter tiles 93. In addition, the letter tiles 92 assembly and in particular the individual letter tiles 94 have their indicia in a color that matches the color of the cube that the indicia comes from, as an example the letter A would be printed in blue on the letter tile 94 to match the first chance element 22 being a blue cube as the letter A is an indicia on the blue cube 22, with the other letters on the blue cube 22, and the remaining four chance elements matching the letter tiles 94 in a like manner to make the letter tiles 94 perceptibly distinctive in matching the five chance elements perceptible distinctiveness. Again, this perceptible distinctiveness between the letter tiles 94 and the five chance elements does not have to be any certain colors, any type of perceptible differentiation would be acceptable.

Method of Use

Figure 6:
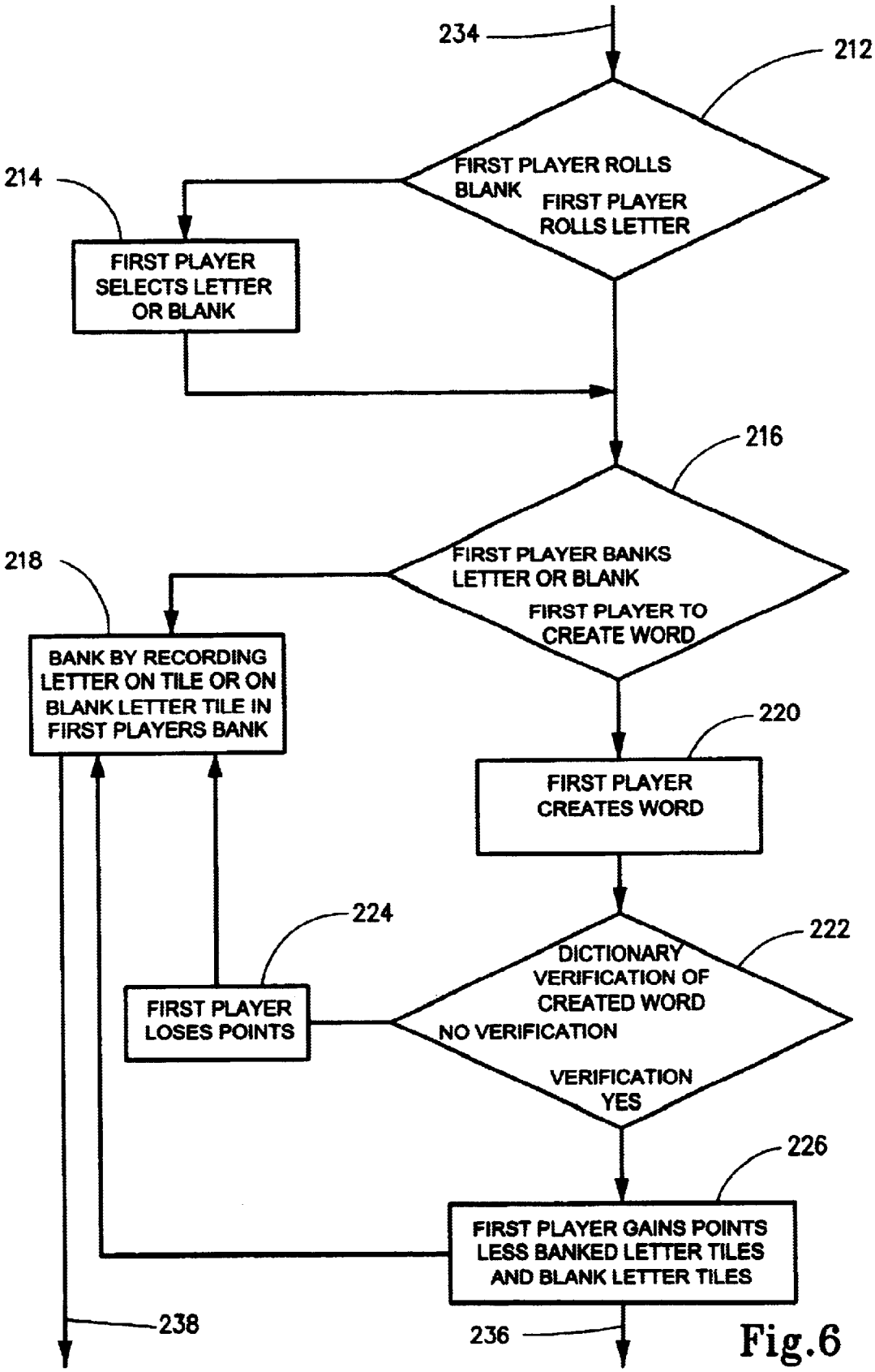
FIG. 6 is a continuation of the functional summary block diagram of the exemplary embodiment of the present invention illustrating the basic method of playing the Alpha Cubes Game.
Figure 7:
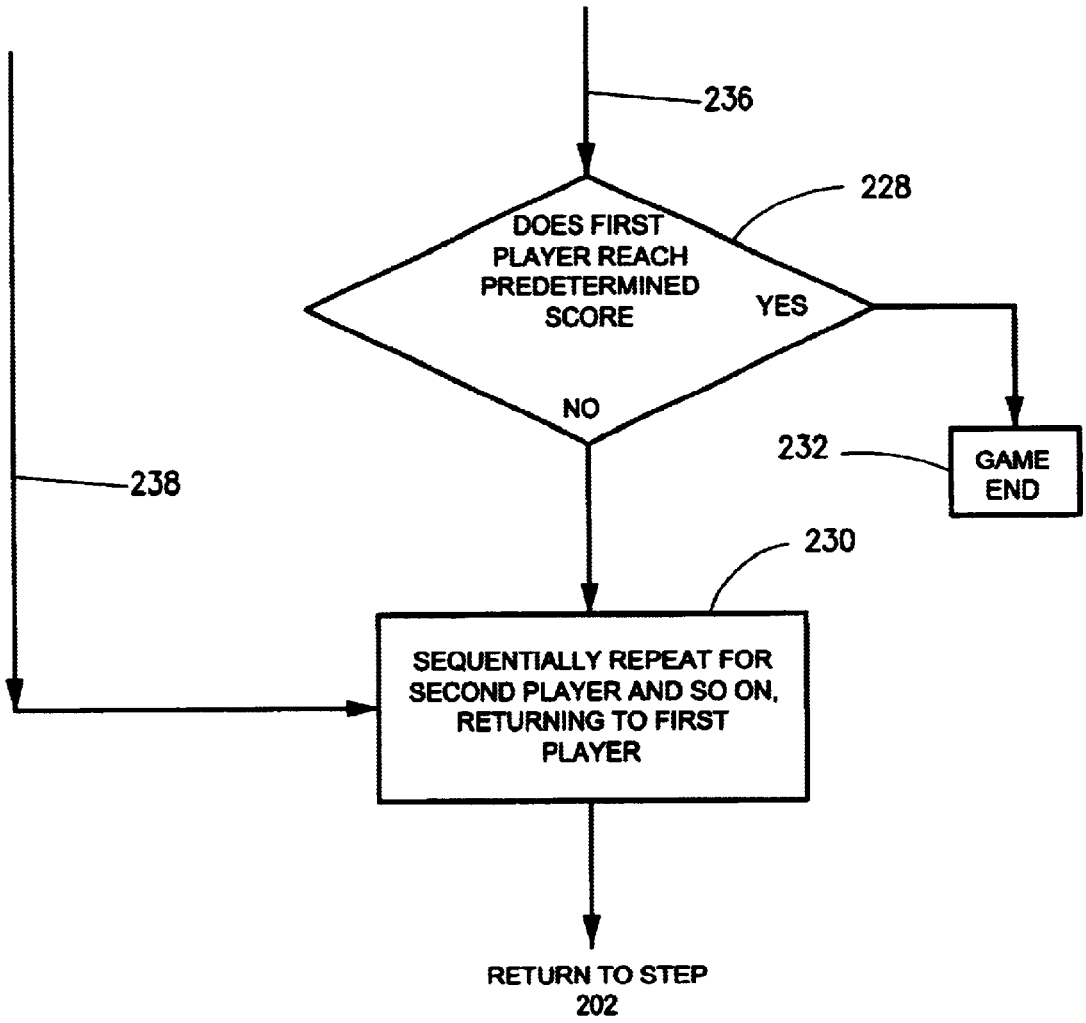
FIG. 7 is a further continuation of the functional summary block diagram of the exemplary embodiment of the present invention illustrating the basic method of playing the Alpha Cubes Game.

Finally looking to FIGS. 5, 6, and 7 shown is a functional summary block diagram 200 of an exemplary embodiment of the present invention illustrating the basic method of playing the Alpha Cubes Game. Note that as the functional summary block diagram continues from FIG. 5 to FIG. 6 to FIG. 7 there are flowchart continuation elements that include, element 234 that is a continuation of step 210 to step 212, element 236 that is a continuation of step 226 to step 228, and element 238 that is a continuation of step 218 to step 230. First off, a few basic aspects of playing the Alpha Cubes Game, as far as a player creating a word there is no limit as to the length of the word or with the type of word that can be created as this is to enable the player to have a higher element of strategy as opposed to chance in attempting to win the game. As a player is rewarded for creating a longer word in length by the use of a higher number of letters it is up to the players' individual strategy whether to bank a high number of letters with the possibility of spelling a longer and more points valuable word as opposed to spelling or creating a high number of a shorter words and minimizing the number of letters in the player's bank which is important because carrying letters in the players' individual letter bank results in a points liability to the player. Because of this, the Alpha Cubes Game can be played by individuals of all ages as the challenges are varied and the points threshold to achieve for the players is suggested to be adjusted based upon the players' ages. The chance elements are initiated one at a time or in the preferred embodiment the cubes are rolled one at a time, with a player having the ability to select the chance element or cube to roll. High point value cubes intentionally have low usage consonants of the English alphabet, wherein low point value cubes have either vowels or high usage consonants of the English alphabet. Thus, a player who spells or creates words that are shorter in length having fewer letters, wherein the letters are either vowels or high usage consonants of the English alphabet would be awarded minimal points. Converse to this, a player who spells or creates words that are long in length with a high number of letters and using letters that are infrequently used consonants in the English alphabet would be awarded the maximum amount of points. Also, a player faces a points liability for the number of letters in their bank with the points liability in proportion to the number of letters in the bank and for the type of letters in that player's bank, in addition another liability the player faces is for the creation of a word that is not able to be authenticated in a dictionary. The letter tiles and the non letter tiles are used by the player to document or record either their letters in their bank or to the document or record the blank chance element credits they have for selecting the letter on that particular chance element. Thus, even when a player is not taking their turn to roll a selected cube they are busy looking at different rearrangements of their letter and non letter bank for strategizing what possible letters they desire for selecting the cube they want to roll on their next turn. It is optional when playing the game whether the individual players keep their letter and non-letter banks confidential from the other players. It is suggested that when adults are playing, that the letter and non letter banks be kept confidential and when children are playing that the letter and non letter banks be kept not confidential between players, thus allowing children more freedom and learning from other players word creation strategy.

The basis of the present invention 20 which is preferably called the Alpha Cubes Game is arranging the letters of the English alphabet on the five chance elements or the five differently colored cubes based upon two criteria, the first criterion being to group all of the five English alphabet vowels together on the first chance element 22 or the blue vowel cube 22 including the sometimes vowel Y. Thus, the blue vowel cube 22 has indicia or letters that are easy to create words with. The second criterion is to group the twenty remaining consonants of the English alphabet on the remaining four chance elements such that the twenty remaining consonants are split into four groups based upon the frequency of use of the consonants in the English alphabet going from the highest usage consonants to the lowest usage consonants. Frequency of letter usage in the English alphabet is based upon the following table number I.

TABLE I

| Highest Frequency | Lowest Frequency |
|---|---|
| E T A O N I S R H D L U F C M W P G Y B V K X J Q Z | |

The remaining four chance elements have the twenty consonants of the English alphabet split between the remaining four chance elements such that the second chance element 36 or the red consonant cube 36 has the first five highest usage consonants, the third chance element 50 or the green consonant cube 50 has the second five highest usage frequency consonants, the fourth chance element 64 or the yellow consonant cube 64 has the third five highest usage frequency consonants, and the fifth chance element 78 or the orange consonant cube 78 has the fourth highest usage frequency consonants. This leaves the remaining four chance elements each with one additional area or side that is left blank also termed the "Wild Face". When the player rolls one of the remaining four chance elements and receives a blank side the player is allowed to select any one of the consonants available on that particular cube. Note that the first chance element 22 being the blue vowel cube 22 does not have a blank side or "Wild Face", as the first chance element has all highly usable letters for the creation of words. The five chance elements with their colors and letters are identified in the following table number II.

TABLE II

| CUBE | COLOR | LETTERS |
|---|---|---|
| 1 | Blue | E A O I U Y |
| 2 | Red | T N S R H Blank |
| 3 | Green | D L F C M Blank |
| 4 | Yellow | W P G B V Blank |
| 5 | Orange | K X J Q Z Blank |

Any number of players can play the Alpha Cubes Game, additionally players can be grouped into teams to play the game, and in accordance with this there is no limit on the numbers of teams with the number of players to a team that can participate in the game. The basic objective of the Alpha Cubes Game is to roll a player selected cube one at a time to determine the letter on the topside of the cube in using the letter to create a word, with players receiving points as previously mentioned on both the length of the word and the letters used to make the word. To play the game, only one basic set of the Alpha Cubes is required being the five chance elements 20 or five cubes 20 of the game. Also, as previously mentioned the use of the letter tiles 92 and non letter tiles 93 is optional not being required to play the game, however, the use of the tiles can assist in player strategy by a continuously rearranging of their bank of letters and non letters to strategize which cube to select for their next turn to roll. To win the game a player normally has to achieve a selected predetermined number of points, which can be variable based upon the age and the skill of the players. The following table number III suggests the preferred points to win based upon age of the players.

TABLE III

| AGE (Years) | POINTS TO WIN GAME |
|---|---|
| 7 and under | 100 |
| 8 to 10 | 150 |
| 11 to 13 | 200 |
| 14 to 15 | 250 |
| 16 and above | 300 |
| Mensa Members | 1,000 |

As previously mentioned scoring the game is based upon two criterion, the first is a sliding scale of points received by the player based upon the letters used with higher point amounts awarded to the player for the more infrequently used consonants in the English alphabet. The following table number IV shows the suggested amount of points to be awarded based upon the cube color that the letter is derived from in the word, with high usage letters including vowels and consonants receiving minimal points and low usage consonants receiving the maximum of the points.

TABLE IV

| COLOR OF CUBE | LETTERS | POINTS |
|---|---|---|
| Blue | E A O I U Y | 1 |
| Red | T N S R H Blank | 1 |
| Green | D L F C M Blank | 2 |
| Yellow | W P G B V Blank | 4 |
| Orange | K X J Q Z Blank | 8 |

The second criterion is based upon word length with the suggested points distribution as indicated in table number V as follows.

TABLE V

| WORD LENGTH | POINTS |
|---|---|
| One-letter | 1 |
| Two-letter | 3 |
| Three-letter | 6 |
| Four-letter | 10 |
| Five-letter | 15 |
| Six-letter | 21 |
| Seven-letter | 28 |
| Eight-letter | 36 |
| Nine-letter | 45 |
| Ten-letter | 55 |
| Eleven-letter | 66 |
| Twelve-letter | 78 |

The method for scoring points for the length of the word created is simply to award one point for the first letter of the word, two additional points awarded for the second letter of the word, three additional points to be awarded for the third letter of the word, four additional points for the fourth letter of the word, and continuing in the same manner for longer and longer words and so on. Thus, in the points for words that are longer in length that is shown in Table number V are to be determined based upon the aforementioned method of adding points for longer words created.

Furthermore, in calculating a player's score with the player awarded points for both the letters used based upon the frequency of the letters use as previously mentioned and the length of the word as also previously mentioned the player also has two points liabilities that are netted against the player's score calculation at the end of each player's turn. The first liability for the player is based upon the size of the player's bank that contains both the letter tiles and the non-letter tiles. The larger the player's bank the more points deducted, based upon the total number of letters in the bank and the type of letters in the bank thus encouraging the players to keep the size of their banks minimized and to create words on a timely basis. The second liability a player faces is when a word that they have created is challenged as being a valid word by another player, and if the other player is successful in the challenge the player who created the word is liable for the points value of the created word had it been valid. Returning to the player's bank points liability, the number of points subtracted are based upon two criterion, the first criterion is based upon the number of letter tiles and non-letter tiles in that player's bank. The second criterion is based upon the letter itself, which is coincidental with the point value of that same particular letter in creating the word, thus vowels and high use consonants lose a minimal amount of points with low use consonants losing a maximum amount of points. More particularly, a blue or red cube causes a player to lose one point, a green cube causes a player to lose two points, a yellow cube causes a player to lose four points, and an orange cube causes a player to lose eight points. Table number VI shows the amount of points to be deducted from a player based upon the number of tiles in that particular player's bank. Thus, one point is subtracted for one tile in the players" bank, two additional points are subtracted for the second tile in the players" bank, three additional points are subtracted for the third tile in the players" bank, and continuing on in a like manner for higher numbers of tiles in the players" bank.

TABLE VI

| TILES IN BANK | POINTS DEDUCTED |
|---|---|
| 1 | 1 |
| 2 | 3 |
| 3 | 6 |
| 4 | 10 |
| 5 | 15 |
| 6 | 21 |
| 7 | 28 |
| 8 | 36 |
| 9 | 45 |
| 10 | 55 |
| 11 | 66 |
| 12 | 78 |
| 13 | 91 |
| 14 | 105 |
| 15 | 120 |

Returning to the ability of a player to challenge another player's creation of a word, this serves as a check upon how creative the player is allowed to be in trying to gain points from their word creation. Typically, when a player's word is challenged and it is found that the word is misspelled or otherwise not an acceptable word according to a mutual agreement among the players, the player who created the invalid word will have to deduct from their score the point value of the misspelled word based upon the aforementioned criteria. In addition, the player who initiated the challenge shall have their score increased by the same number of points that the other player lost who created the invalid word. However, the challenging player's score cannot be increased equal to or above the net score needed to win the game. As an example, if 200 points are needed to win the game, the successful challenging player's score can only be increased to a maximum of 199. To add risk to the challenger, if it is found that the challenged word is valid than the challenging player shall have deducted from their score a point value of the word challenged. If the challenging player has a net score over the amount needed to win the game they are permitted to challenge a word, however, their score will not be increased for a successful challenge but the challenger will face points liability for reduction if the challenged word is acceptable. If there are multiple players who want to challenge a word that is created by another player then all players wishing to challenge the created word should roll the blue vowel cube 22. The challenging player rolling the letter closest to the end of the alphabet from the blue vowel cube 22 shall be allowed to make a challenge. In the event of a tie the players shall continue to roll the blue vowel cube 22 until one player comes closest to the end of the alphabet and is allowed to challenge. The authority to determine the created word validity would normally be with the use of a dictionary, however, the players can agree to modifications to created word validity prior to the start of the game.

Looking specifically at FIG. 5 the game is started at step 202 to determine which player or team has the choice of starting the game, thus all the players roll the blue vowel cube 22 once and the player who has the letter closest to the beginning of the alphabet is deemed the choice player and has the option to make the decision 204 to allow themselves to go first or to select any other player at step 206, or team to go first thus being the first player or first team. If two or more players tie in determining who goes first, those players shall roll the blue vowel cube 22 again to break the tie, if another tie occurs, the players shall continue to roll blue vowel cube 22 until there is no longer a tie to determine which player or team goes first as previously mentioned. At this point the player who is going first makes the decision at step 208 to select any one of the five chance elements to initiate. In the preferred embodiment of the present invention, the first player to roll selects any one of the five colored cubes to roll, meaning that only one cube is rolled at a time, of course this would be a strategic decision on the part of the player in that each one of the five different colored cubes has different implications for the letters available and the resulting points that can possibly be obtained by the first player. Next, the first rolling player takes the color cube they have selected and rolls it at step 210, resulting with the top facing indicia or letter or blank side on the cube being available to the first player. Note that it is absolutely mandatory for the first player to select a colored cube and the first player must roll the cube, it is not allowed for the first player to "pass" when their turn comes up. If the color cube that the player selected results in a blank side termed the "Wild Face" at step 212 the first player then can make the decision to select any letter from that same color cube that was rolled at step 214 to make the decision at step 216 to either bank the selected letter 218 or to attempt to use at the selected letter to create a word at 220. Another option available to the first player if they roll from the color cube a resulting blank side on the top of the cube at step 212 the first player has the option of banking a non indicia or blank color tile that allows the player to later select a letter that would be of use to the player from the color tile in that the letter available for the first player selection would have to be from the cube that is the same color as the non indicia or blank color tile. Returning to step 210 if the first player when rolling the selected color cube results in a letter being on the topside of the cube at 212 then the first player must decide 216 when using that particular letter on whether to bank the letter 218 or to attempt to use the letter in the creation of a word 220. Note that the first player if they decide to create a word 220 on their turn is only allowed to create one single word on that turn, it is not allowed to create multiple words on a player's turn.

At this point the first player has created a word 220 in an attempt to gain points, however, the first player is now subject to a challenge from any other player to verify the authenticity of the created word 222, as previously stated, typically a dictionary is used for this purpose, also the players can previously have agreed before the start of the game to alternative rules for the verification of the created word, such as the word VICKS as shown in FIG. 1, which is not necessarily a dictionary word, but could be agreed upon as an authentic word that would be acceptable for points to be awarded to a player. Absent a challenge, the first player will be awarded points for the word based upon the word length and the letters used as previously described. If there is a successful challenge to the first player's created word 222 the first player will lose points equal to the value of the word 224 and the successful challenger will gain an equal amount of points, but, however, will be prevented from winning the game from challenge points as previously described. An unsuccessful challenge of the created word 222 will result in a challenger losing points equal to the value of the word. Assuming that the first player is either not challenged or is successful against the challenger with a valid word being created, the first player has a net score calculation 226 that will evaluate the points gained from the valid created words the player has cumulated at that point minus the points deducted for both the size of the first player's bank and the type of letters contained in the first player's bank as previously described. Once the first player's net score is determined there is a comparison check 228 to ascertain whether the first player has achieved a net score that is equal to or greater than a selected predetermined score, if this is the case then the first player has won the game and the game ends 232. If, at decision step 228 the first player's net score is less than the predetermined score then the game will continue and sequentially repeat for the second player, the third player, and continuing in a like manner eventually returning to the first player to have a second turn 230. If at this point, in the case of the first player having achieved the selected predetermined score and there were remaining other players who not had an equal number of turns as the first player, those remaining other players would be allowed to complete their turns to ensure fairness, wherein if any of the other players who take their remaining turn achieve a higher net score than the first player, they would be the winner of the game. In the event of a tie between two or more players, wherein multiple players have an equal net score that is above the selected predetermined score, than those tied players shall each take another turn or more with the game winner determined from which player has the highest net score.

Conclusion

Accordingly, the present invention of an Alpha Cubes Game has been described with some degree of particularity directed to the embodiments of the present invention. However, the method of playing the Alpha Cubes Game can have a number of modifications in scoring, and rules for play by mutual agreement of the players. As an example, the vowel U and sometimes vowel Y if they are rolled frequently can be given a higher points value than previously described as U and Y are moderate use letters and could be worth more points in word construction than previously described. Also, the number of U and Y letter tiles allowed in a player's bank could be limited with a player being given an extra turn to roll a letter other than U or Y or to continue rolling until a letter other than U or Y is achieved. Another alternative is to make either or both the U or Y a "Wild Face" as previously described. It should be appreciated, though, that the present invention is defined by the following claims construed in light of the prior art so modifications and changes may be made to the exemplary embodiments of the present invention without departing from the inventive concepts contained therein.

What is claimed is:

1. A competitive points based English alphabet word construction game method for players who create words from letters determined from a group of chance elements, wherein long words created from infrequently used letters are selectively rewarded with enhanced points levels, comprising the steps of:

(a) providing a competitive points based word construction game apparatus comprising:

(i) a first chance element including six (6) indicia bearing areas, each of an indicia bearing area representing one of the five (5) English alphabet vowels, being A, E, I, O, U, and including a letter Y for said six (6) indicia; and (ii) a second, a third, a fourth, and a fifth chance elements each including said six (6) areas having a distinct perceptible indication, for a total of twenty four (24) areas, said twenty four (24) areas each including an indicia representing a unique one of the twenty (20) consonant letters of the English alphabet resulting in each consonant being represented once as said indicia and four (4) non indicia areas;

(b) initiating said first chance element by each player wherein the player who has an indicated indicia that is closest to a selected game criteria is determined to be a choice player;

(c) selecting by said choice player to be a first player or selecting another player to be said first player;

(d) selecting by said first player a chance element to initiate, being one of said first, second, third, fourth, or fifth chance elements for a singular chance element;

(e) initiating said selected singular chance element by said first player wherein said first player has an indicated indicia from said selected singular chance element;

(f) deciding by said first player to use said indicated indicia letter only for said first player to create a word or to store said indicated indicia letter only in a first player letter bank;

(g) verifying said created word in a dictionary for authenticity based upon a challenger from any other player who is termed a challenger;

(h) calculating said first player score according to a selected criteria, if said created word is verified in said dictionary said first player receives a points addition and said challenger loses an equal number of points, if said created word is not verified in said dictionary said first player receives a points deduction and said challenger gains an equal number of points;

(i) comparing said first player score to a selected predetermined score and ending said game, if said first player score equals or exceeds said predetermined score and continuing said game if said first player score is less than said predetermined score; and (j) repeating sequentially said steps (d) through (i) if said first player score is less than said selected predetermined score, wherein subsequent players take the place of said first player in said steps (d) through (i) with all players sequentially repeating said steps (d) through (i).

2. A competitive points based word construction game method according to claim 1 wherein said step of calculating said first player score further comprises the longer the word based upon a higher number of letters being used in said created word results in enhanced points levels awarded to said first player.

3. A competitive points based word construction game method according to claim 1 wherein said step of calculating said first player score further comprises said second, third, fourth, and fifth chance elements that have said consonants arranged such that said second chance element has the five (5) highest frequency of use consonants in the English alphabet, said third chance element has the five (5) second highest frequency of use consonants in the English alphabet, said fourth chance element has the five (5) third highest frequency of use consonants in the English alphabet, and said fifth chance element has the five (5) lowest frequency of use consonants in the English alphabet, with enhanced points levels being awarded to said first player for the use of lower frequency of use consonants in said created word.

4. A competitive points based word construction game method according to claim 1 wherein said step of calculating said first player score further comprises that points are deducted from said first player score based upon the number of said indicated indicia letters in said first player letter bank such that a higher number of said indicia letters results in a higher points deduction.

5. A competitive points based word construction game method according to claim 1 wherein said step of calculating said first player score further comprises that points are deducted from said first player score based upon the type of said indicated indicia letters in said first player letter bank such that higher frequency of use letters are lower points deductions and lower frequency of use letters are higher points deductions.

6. A competitive points based word construction game method according to claim 1 wherein said step of initiating said selected singular chance element by said first player further comprises that if said first player has an indicated non indicia area on said selected singular chance element said first player is allowed to utilize any one selected indicia from said singular chance element.

7. A competitive points based word construction game method according to claim 6 said step of deciding by said first player to use said indicated non indicia area to create a word further comprises the ability to store said indicated non indicia area in said first player letter bank by the use of a non indicia tile that is perceptibly distinctive to match a perceptibly distinctive first, second, third, fourth, or fifth chance element.

8. A competitive points based word construction game method according to claim 1 wherein said step of deciding by said first player to use said indicated indicia letter to create a word or to store said indicated indicia letter in a first player letter bank further comprises the use of a letter tile to record said first player banked letter.

* * * * *